US006820854B2

(12) United States Patent
Oetiker et al.

(10) Patent No.: US 6,820,854 B2
(45) Date of Patent: Nov. 23, 2004

(54) STAND FOR A WALKING STICK AND CRUTCHES

(75) Inventors: Hans Oetiker, deceased, late of Horgen (CH); by Paul Nef, legal representative, Herrliberg (CH); by Marco Lorez, legal representative, Meilen (CH)

(73) Assignee: Hans Oetiker AG Maschinen-und Apparatefabrik, Horgen (CH)

( * ) Notice: Subject to any disclaimer, the term of this patent is extended or adjusted under 35 U.S.C. 154(b) by 0 days.

(21) Appl. No.: 10/239,926

(22) PCT Filed: Feb. 13, 2001

(86) PCT No.: PCT/CH01/00094

§ 371 (c)(1),
(2), (4) Date: Feb. 12, 2003

(87) PCT Pub. No.: WO01/72183

PCT Pub. Date: Oct. 4, 2001

(65) Prior Publication Data

US 2003/0146362 A1 Aug. 7, 2003

(30) Foreign Application Priority Data

Mar. 27, 2000 (CH) ..... 578/00

(51) Int. Cl.[7] ..... A47G 25/12

(52) U.S. Cl. ..... 248/529; 211/62; 206/443; 248/346.3

(58) Field of Search ..... 52/98; 211/62, 211/63; 135/65; 248/512, 513, 518, 519, 529, 534, 535, 539, 314, 346.3; 431/29.5; 206/443; 224/915

(56) References Cited

U.S. PATENT DOCUMENTS 716,968 A * 12/1902 Warner ..... 52/298
1,103,257 A * 7/1914 Bollinger, Jr. ..... 248/512
1,598,016 A * 8/1926 Runser ..... 248/539
2,714,496 A * 8/1955 Doyle ..... 248/539
3,167,292 A * 1/1965 Meyerowitz ..... 248/230.1
3,579,936 A * 5/1971 Andersson et al. ..... 52/297
3,809,346 A * 5/1974 Jackson ..... 248/530
4,515,195 A * 5/1985 Gladstein ..... 144/366
5,094,422 A * 3/1992 Tiffany ..... 248/519
5,639,055 A * 6/1997 Fritz ..... 248/519
5,676,290 A * 10/1997 Liu ..... 224/275
5,685,517 A * 11/1997 Salibra ..... 248/519
5,743,505 A * 4/1998 Sofy ..... 248/346.01
5,871,172 A * 2/1999 Speakes ..... 244/1 R
6,088,946 A * 7/2000 Simmons ..... 43/15

FOREIGN PATENT DOCUMENTS

| | | | |
|---|---|---|---|
| CH | 282 995 A | | 5/1952 |
| DE | 434 473 C | | 9/1926 |
| DE | 197 47 631 A | | 9/1999 |
| DE | 299 17 064 | | 3/2000 |
| EP | 692 436 A | | 1/1996 |
| JP | 2000157404 A | * | 6/2000 |

* cited by examiner

*Primary Examiner*—Anita King
*Assistant Examiner*—Jon Szumny
(74) *Attorney, Agent, or Firm*—Pearne & Gordon LLP

(57) ABSTRACT

The invention relates to a device for depositing longish stick-type articles of daily use such as especially, walking aids, crutches, umbrellas, walking sticks used for hiking and similar in an upright or essentially vertical position. Said device has a base plate (7), at least one detachably connectable tubular element (3, 5) and a fixing mechanism (11) for detachably fixing said tubular element (3, 5) to the base plate (7). There are preferably at least two tubular elements (3, 5) arranged side by side as an identical pair, so that each can hold at least one stick-type object such as e.g., one crutch of a pair, respectively.

10 Claims, 4 Drawing Sheets

STAND FOR A WALKING STICK AND CRUTCHES

This invention relates to a device for the upright i.e. essentially vertical storage of elongated, stick-shaped objects such as walking sticks, canes, crutches, umbrellas, hiking staffs and the like, and to a walking-stick and crutch stand incorporating such a device.

Handicapped or elderly persons often face the problem of not knowing how and where to deposit their cane or crutches at a doctor's office, at a restaurant etc. More often than not these walking aids are laid flat on the floor, constituting a hazard for other people.

This very problem has prompted the inventor of the innovation here presented, Mr. Hans Oetiker, to come up with a solution to this unacceptable situation.

When visiting his physician, Mr. Oetiker, himself handicapped due to a hip operation, witnessed an accident with tragic consequences in the doctor's waiting room. In the absence of a better place, a patient in the waiting room laid his crutches flat on the floor, another patient tripped over these crutches and sustained serious injuries. As a result of that accident that person then had to undergo an operation which he did not survive. In view of that incident Mr. Oetiker then conducted a search for devices that would allow safe placement of walking aids and crutches. The racks and stands he found such as those made by Binder Rehab Home and Hospital Supplies of CH-5612 Villmergen/AG or by Hans Achermann Foundries and Metalworks of CH-5122 Menznau/LU turned out to be too heavy (about 6.5 to 11 lbs.), too bulky and too awkward to handle. No wonder, then, that these commercially available stands are hardly being used for instance for crutches at doctor's offices, in restaurants, in public buildings etc.

It has therefore been an objective of this invention to introduce a device for holding such objects as walking aids and crutches, allowing easy manipulation while avoiding the drawbacks of the racks and stands currently on the market.

According to the invention this objective is achieved by means of a device as described in claim 1.

The proposed solution is a device for the upright, essentially vertical placement of elongated, stick-shaped objects such as the above-mentioned walking aids, crutches, umbrellas, hiking staffs and the like, characterized by the following features:

- a baseplate
- at least one tubular element that can be detachably connected to the baseplate, and
- a retaining element that holds the minimum of one tubular element detachably on the baseplate.

In a preferred design version, at least two tubular elements are provided which, extending side-by-side in twin fashion, can each accommodate at least one stick-shaped object such as the aforementioned crutch.

The baseplate preferably features positioning aids such as pins, lugs, detents and/or the like serving to hold the tubular element or elements in a position preferably centered on the baseplate.

In a preferred design variation, at least one punched-in prominence, its diameter essentially matching the inner diameter of one of the tubes, projects from the baseplate and is preferably tapered so as to cause the prominence to guide the respective tube into its proper position on the baseplate.

In addition, the tubular element or juxtapositioned twin tubes is/are provided with at least one guide channel or guide tube through which a rod-shaped retaining element can be installed. The baseplate is provided with a socket in which the front end of the rod-shaped retaining element can be inserted, which front end can be locked in place in the said socket by way of a thread, a bayonet-type slide catch or a similar locking feature.

The rod-shaped retaining element may consist for instance of two parts including a first rod section with a threaded end and, at the far end from the threaded end, a stop collar which, bearing on the guide tube at the far end away from the baseplate, serves to clamp the tubular element or elements against the baseplate. If an additional rod section is used, it can be detachably screwed or plugged into the first section, with the additional rod section preferably featuring a lifting provision at its end.

The upper opening of the tubular element(s) is preferably chamfered relative to the longitudinal axis of the tube and is provided with at least one perforation in the wall of the tube(s) near the upper opening by means of which the tube(s) can be mounted for instance on a wall using a suitable fastener such as a screw, a hook or the like.

The characterizing features of other preferred design variations of the device according to this invention are specified in the subclaims.

As mentioned above, the device per this invention lends itself in particular to the accommodation or depositing of walking aids and crutches. However, the device according to the invention can serve equally well for holding umbrellas, hiking staffs and other oblong objects.

The following implementation examples will serve to explain this invention in more detail with reference to the attached drawings in which FIG. 1 is a perspective front view of a device per this invention in its assembled state;

FIGS. 2*a* and 2*b* are top and, respectively, side views of a baseplate design variation of the device per FIG. 1 in the direction of the arrow I—I;

FIGS. 3*a* and 3*b* are top and, respectively, side views of another baseplate design variation along the line II—II;

Figure 1:
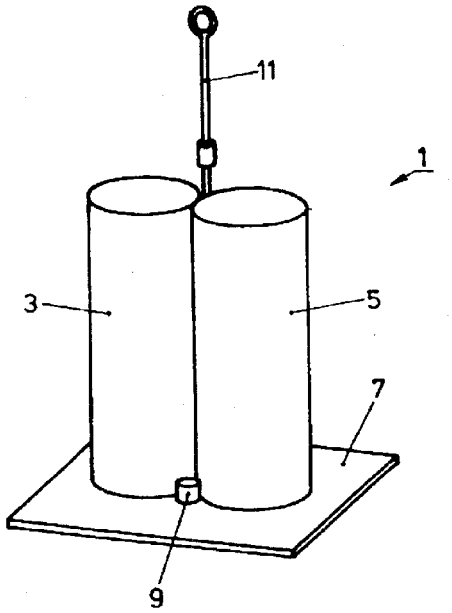

FIG. 1 is a perspective frontal view of a device according to the invention, in this case a walking-stick stand 1 capable of accommodating at least one pair of crutches. The walking-stick/crutch stand 1 encompasses tubular twin holders i.e. tubes 3 and 5 that are firmly attached to each other and to a baseplate 7. To ensure positionally correct retention of the two tubes 3 and 5 on the baseplate 7, the front end of the baseplate 7 is provided, at the connecting point with the two tubes, with a punched-out boss-type locating lug 9, more clearly illustrated in FIGS. 2*a* and 2*b*. On the back side of the baseplate 7 the two tubes 3 and 5 are attached via a retaining rod 11.

Figure 2A:
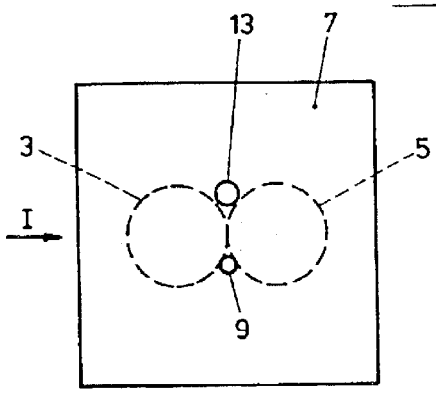
Figure 2B:
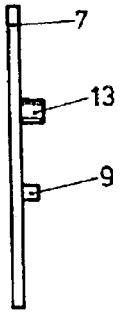

FIGS. 2*a* and 2*b* show a design variation of the baseplate 7 featuring the above-mentioned lug 9 in front and a threaded socket 13 situated in the rearward mounting area for the two tubes 3 and 5, indicated in FIG. 2*a* by a dotted outline.

Especially in FIG. 2*b*, the projecting locator lug 9 is clearly illustrated, as is the threaded socket 13 that may be inserted for instance in a perforation of, or embedded in, the baseplate 7.

Figure 3A:
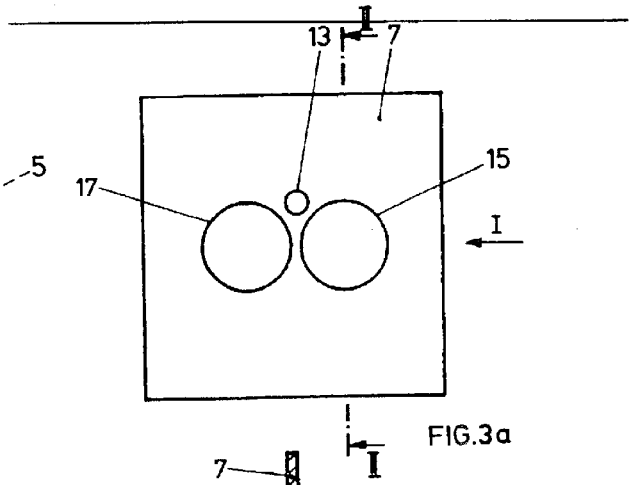
Figure 3B:
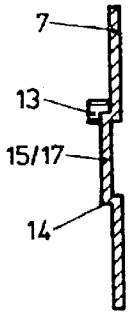

FIGS. 3*a* and 3*b* show another design variation of the baseplate in which, in lieu of the forward lug 9, two punched-out projections 15 and 17, approximately matching the inner diameter of the two tubes 3 and 5, are provided in addition to the threaded socket 13. The outer rim 14 of these two projections is preferably tapered as is clearly indicated especially in FIG. 3*b*. FIG. 3*b* is a lateral view in the direction of the arrow 1-1, hence the two projections 15 and 17 are lined up one behind the other and only one projection is visible.

Figure 4:
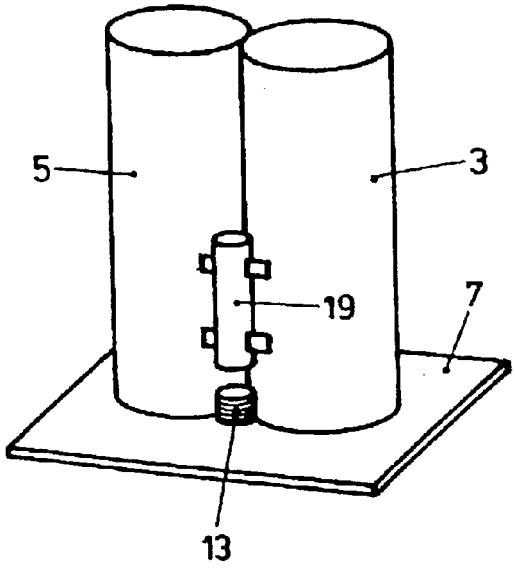
FIG. 4 is a perspective rear view of two tubes mounted twin-style on a baseplate.
Figure 5:
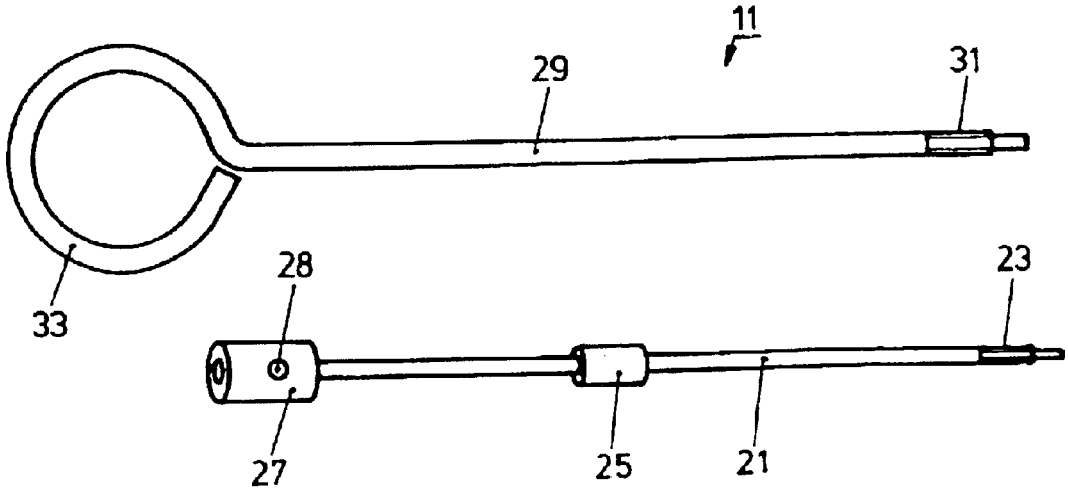
FIG. 5 shows a two-part retaining rod for attaching the tubes to the baseplate.

FIG. 4 is a perspective rear view of the two tubes 3 and 5, plugged into the baseplate 7, without the retaining rod. Clearly identifiable in FIG. 4 is a tubular guide 19 through which extends the retaining rod that is illustrated in FIG. 5 in the unmounted state. As an example, the retaining rod 11 may consist of two parts as shown in FIG. 5. A first, lower retaining rod section 21 may be provided at its front end with a thread 23 allowing it to be mounted in the matching threaded socket 13. The bottom rod section 21 is slipped through the tubular guide 19, with a collar 25 butting against the upper end of the guide 19 and serving to clamp the two tubes 3 and 5 firmly against the baseplate 7 when the rod 21 is screwed into the threaded socket 13. At its end the lower retaining rod 21 is provided with an additional, preferably corrugated protuberance 27 that is preferably provided with a perforation 28. The latter will be discussed further below.

The first rod section can be screwed with its threaded end 31 into a second retaining rod 29 whose upper end may be provided with a lifting handle 33, allowing the assembled device per this invention to be easily lifted off the floor and carried.

Figure 6:
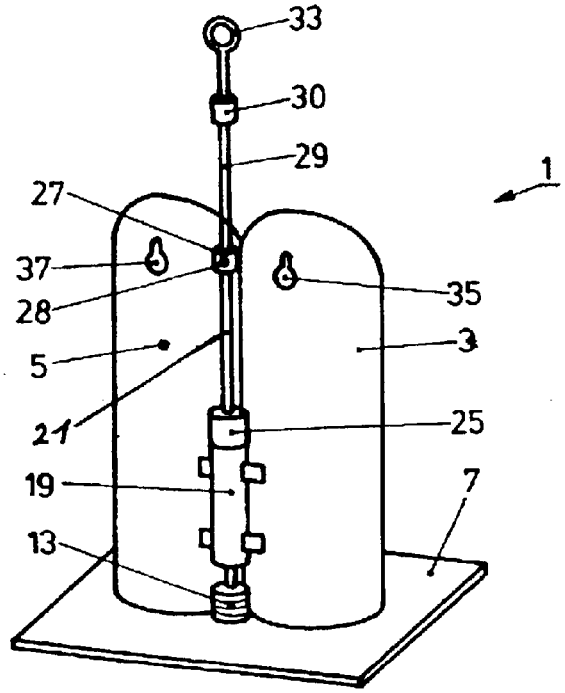
FIG. 6 is a perspective rear view of an assembled device according to the invention.

FIG. 6 is a perspective rear view of the device 1 of this invention in its assembled state, with the retaining rod 11 inserted and screwed in. Also shown in FIG. 6 are two perforations 35 and 37, preferably punched into the upper section of the two tubes 3 and 5 and serving the functional purpose discussed in more detail with reference to FIG. 8.

If the device per FIG. 1 or FIG. 6 is to be disassembled, the two retaining rod sections 21 and 29 can be unscrewed from the threaded socket 13. First, the upper rod section 29 is removed, then the lower rod section, in the process of which the counterpressure exerted by the collar 25 butting against the upper part of the guide tube 19 resists the unscrewing of the lower rod section. The previously detached upper rod section 29 can now be inserted through the perforation 28, and by using leverage action it is now possible to easily unscrew the lower rod section 21 from the threaded socket 13.

Figure 7:
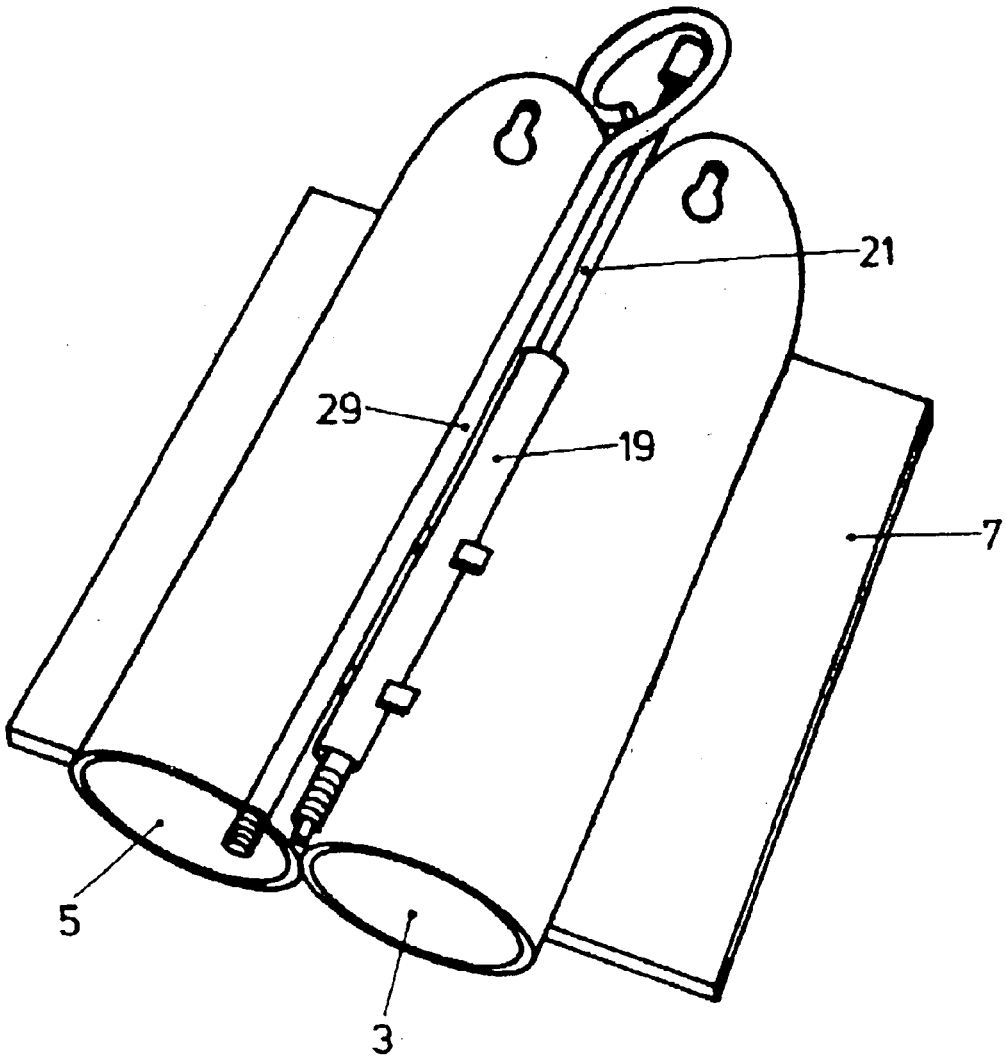
FIG. 7 illustrates the device per this invention, disassembled for shipment.

Once the rods are removed, the two tubes 3 and 5 can be easily lifted off the baseplate 7 and, as is manifest in FIG. 7, the entire device can be stored with a minimum of space requirements. In its disassembled state per FIG. 7, the device according to the invention can be effortlessly carried in a bag, a briefcase or the like. Especially when the device per this invention is made for instance of aluminum, its weight can be held below 2.2 lbs., so that carrying the device per this invention around poses no problem. Of course, it is not imperative that the device be made from aluminum. It is equally possible, for example, to produce the baseplate from iron and the plug-in tubes from a plastic substance, for instance a fiber-reinforced synthetic material.

Figure 8:
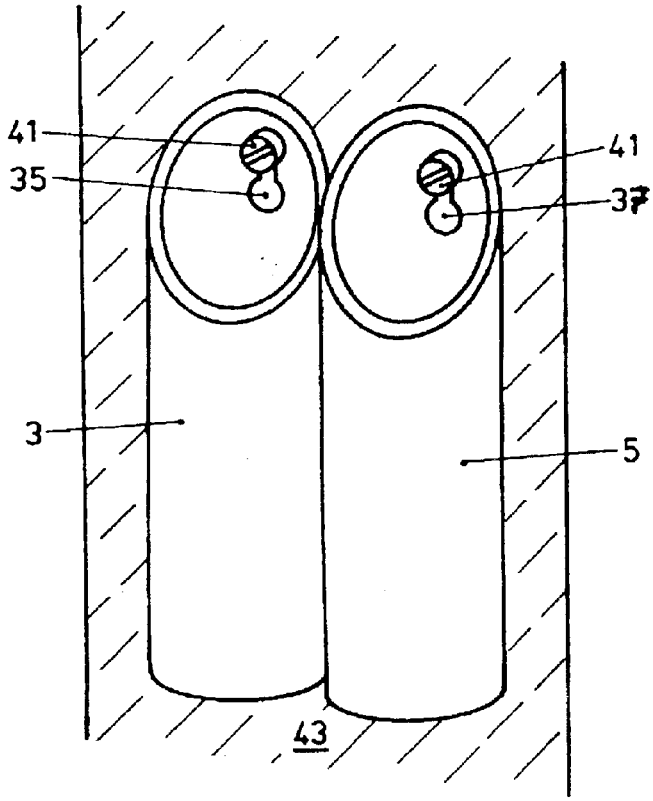
FIG. 8 is a perspective front view of a twin-tube assembly mounted with fasteners against a wall.

However, by means of the two perforations 35 and 37 shown in FIG. 6, it is also possible to hang the two tubes 3 and 5 on wall mounts such as screws 41 as illustrated in FIG. 8. In lieu of the screws shown it is equally possible to use hooks or other fasteners. In the case of wooden walls 43 wood screws will serve the purpose, while in the case of concrete walls off-the-shelf wall anchors can be used.

In place of the twin tubes 3 and 5 it is also possible, of course, to use one single tube only, or two mutually attachable and separable tubes that may be laterally plugged, clipped or snapped together via appropriate quick-connect provisions.

It goes without saying that the devices illustrated in FIGS. 1 to 8 only represent design examples of this invention serving to explain the invention in more detail. Evidently, the designs may be altered, modified or complemented by additional elements in any form or fashion whatsoever. For example, it is not at all necessary to produce the rod-shaped retaining element 11 in two parts; it may equally well be designed as one part or in three or more parts. Alternatively, the rod-shaped retaining element may be so designed that the upper section 29 by itself can be used for fastening the two tubes 3 and 5 to the baseplate 7 in that, for example, the protuberance 30 bears down on the upper end of the guide tube 19 as the threaded front end 31 engages in the threaded socket 13 in the baseplate 7. The upper ends of the tubes may be chamfered or straight, they may have a closed or, as shown in FIGS. 1 to 8, an open bottom. The choice of materials as well is of no particular significance, as long as the device per this invention permits the stable, positionally steady placement of walking aids, crutches and similar objects which requires a certain intrinsic weight of the device.

What is claimed is:

1. A device for holding a stick-shaped object in an upright position comprising:

a base;

a holder detachably mounted on said base for holding said object;

a projection protruding from said base, the projection having an outer shape matching an inner shape of said holder to position the projection on the base;

a retaining rod having a lower end adapted to engage a socket provided on said base for removably fixing said holder to the base; and a guide sleeve mounted on said holder and adapted to permit said retaining rod to pass through the guide sleeve, the retaining rod having a collar portion adapted to engage said guide sleeve when the lower end of the retaining rod is fixed in said socket.

2. The device of claim 1, wherein the lower end of said retaining rod and said socket are threaded.

3. The device of claim 2, wherein said retaining rod includes a lower section provided with said collar portion, and an upper section fastened to the lower section and having a portion adapted to engage a transverse bore provided in said sleeve portion to assist unfastening of the lower section from said socket.

4. The device of claim 1, wherein an upper end of said retaining rod, in an assembled condition of the device, projects above an upper end of said holder and is formed with a handle.

5. The device of claim 1, further comprising a pair of releasably interconnected holders mounted side by side.

6. A device for holding stick-shaped objects in an upright position comprising:

a base;

a pair of interconnected holders detachably mounted on said base, each for holding one of said objects;

a projection protruding from said base to position said holders on said base by engaging a portion between said interconnected holders;

a retaining rod having a lower end adapted to engage a socket provided on said base for removably fixing said holders to said base; and a guide sleeve mounted on said holders and adapted to permit said retaining rod to pass through the guide sleeve, said retaining rod having a collar portion adapted to engage said guide sleeve when the lower end of the retaining rod is fixed in said socket.

7. The device of claim 6, wherein said holders are releasably interconnected.

8. The device of claim 6, wherein the lower end of said retaining rod and said socket are threaded.

9. The device of claim 8, wherein said retaining rod includes a lower section provided with said collar portion, and an upper section fastened to the lower section and having a portion adapted to engage a transverse bore provided in guide sleeve to assist unfastening of the lower section from said socket.

10. The device of claim 6, wherein an upper end of said retaining rod, in an assembled condition of the device, projects above an upper end of said holder and is formed with a handle.

* * * * *

UNITED STATES PATENT AND TRADEMARK OFFICE

CERTIFICATE OF CORRECTION

PATENT NO. : 6,820,854 B2
DATED : November 23, 2004
INVENTOR(S) : Hans Oetiker et al.

It is certified that error appears in the above-identified patent and that said Letters Patent is hereby corrected as shown below:

Title page,
Item [73], Assignee, after "Hans Oetiker AG", please insert -- , (comma) --.

Column 1,
Line 34, after "public buildings etc.", please insert -- Similarly, DE-197 47 631 proposes a holding device for walking aids that corresponds to those referred to above and is again characterized by its considerable weight due to the use a heavy baseplate. --.

Signed and Sealed this

Twenty-third Day of August, 2005

JON W. DUDAS
*Director of the United States Patent and Trademark Office*